US008081082B2

(12) United States Patent
Malik et al.

(10) Patent No.: US 8,081,082 B2
(45) Date of Patent: Dec. 20, 2011

(54) MONITORING PATTERNS OF MOTION

(75) Inventors: Nadeem Malik, Austin, TX (US); Katherine June Pearsall, Austin, TX (US); Adrian Rutledge, Dublin (IE); Elizabeth Vera Woodward, Cedar Park, TX (US)

(73) Assignee: International Business Machines Corporation, Armonk, NY (US)

( * ) Notice: Subject to any disclaimer, the term of this patent is extended or adjusted under 35 U.S.C. 154(b) by 386 days.

(21) Appl. No.: 12/473,181

(22) Filed: May 27, 2009

(65) Prior Publication Data

US 2010/0302041 A1 Dec. 2, 2010

(51) Int. Cl.
*G08B 23/00* (2006.01)

(52) U.S. Cl. ..... 340/573.1; 340/573.4; 340/522; 340/529; 340/562; 340/566; 340/539.13; 340/539.22; 600/552; 600/595

(58) Field of Classification Search ..... 340/573.1, 340/573.4, 522, 529, 562, 566, 539.13, 539.22; 600/552, 595, 848
See application file for complete search history.

(56) References Cited

U.S. PATENT DOCUMENTS

| | | | | |
|---|---|---|---|---|
| 6,201,476 | B1 * | 3/2001 | Depeursinge et al. | 340/573.1 |
| 6,433,690 | B2 * | 8/2002 | Petelenz et al. | 340/573.1 |
| 6,847,892 | B2 | 1/2005 | Zhou et al. | |
| 7,248,172 | B2 * | 7/2007 | Clifford et al. | 340/573.1 |
| 7,423,537 | B2 * | 9/2008 | Bonnet et al. | 340/573.1 |
| 7,443,301 | B2 | 10/2008 | Tucker et al. | |
| 7,961,109 | B2 * | 6/2011 | Jang et al. | 340/573.1 |
| 2006/0001545 | A1 | 1/2006 | Wolf | |
| 2006/0282021 | A1 | 12/2006 | DeVaul et al. | |
| 2007/0085690 | A1 | 4/2007 | Tran | |

FOREIGN PATENT DOCUMENTS

| | | | |
|---|---|---|---|
| WO | 2006119344 | A2 | 11/2006 |
| WO | 2007113842 | A2 | 10/2007 |

OTHER PUBLICATIONS

"The Use of New Medical Technologies within the NHS", House of Commons Health Committee, Fifth Report of Session 2004-05, vol. II, Apr. 15, 2005, pp. 1-138.
Koal, "Polymer Piezoelectric Sensor of Animal Foot Pressure", retrieved Apr. 7, 2009, pp. 1-12. http://www.freepatentsonline.com/4499394.html.
Swedberg, "Researchers Use RFID to Fight SIDS", RFID Journal, Inc., retrieved Jan. 23, 2009, pp. 1-2. http://www.rfidjournal.com/article/articleprint/3252/-1/1/.

(Continued)

*Primary Examiner* — Tai T Nguyen
(74) *Attorney, Agent, or Firm* — Yee & Associates, P.C.; Steven L. Bennett

(57) ABSTRACT

A method, computer program product, and apparatus for monitoring patterns of motion are provided. A signal is received from a sensor on a user, wherein movement of the user causes the sensor to generate power to emit a signal indicative of the movement of the user. The signal is analyzed to form a current pattern of motion. The current pattern of motion is compared to a baseline pattern of motion associated with the user. A difference between the current pattern of motion and the baseline pattern of motion associated with the user is determined to form a difference. The difference is compared to a predetermined threshold. Responsive to the difference exceeding the predetermined threshold, an alert is sent.

20 Claims, 3 Drawing Sheets

OTHER PUBLICATIONS

Lai et al., "Vibration Powered Battery-Assisted Passive RFID Tag", Department of Mechanical Engineering, University of California Berkeley, retrieved Jan. 23, 2009, pp. 1-13.

"Medical Alert Systems and Pill Dispensers", VRI, retrieved Jan. 23, 2009, pp. 1-2.

"Medic Alert Systems—It's About Your Independence", Rescue Alert, retrieved Jan. 23, 2009, pp. 1-2.

"Help at the Push of a Button", Medical Alarm.com, retrieved Jan. 23, 2009, 1 page.

* cited by examiner

MONITORING PATTERNS OF MOTION

BACKGROUND

1. Field

The disclosure relates generally to monitoring motion and, more specifically, to a method, system, and computer program product for monitoring patterns of motion.

2. Description of the Related Art

There are numerous situations in which being able to detect movements of a person's body, to detect problematic patterns, to provide configurable alerts when problematic patterns are detected, and in some cases, to provide the location of the individual at the time that the pattern occurs, could have a profound impact on the long-term physical welfare of the individual. Presently, there are no comprehensive, inexpensive, convenient and easily portable solutions to address this problem.

SUMMARY

According to one embodiment of the present invention, a signal is received from a sensor on a user, wherein movement of the user causes the sensor to generate power to emit a signal indicative of the movement of the user. The signal is analyzed to form a current pattern of motion. The current pattern of motion is compared to a baseline pattern of motion associated with the user. A difference between the current pattern of motion and the baseline pattern of motion associated with the user is determined to form a difference. The difference is compared to a predetermined threshold. Responsive to the difference exceeding the predetermined threshold, an alert is sent.

DETAILED DESCRIPTION

Figure 1:
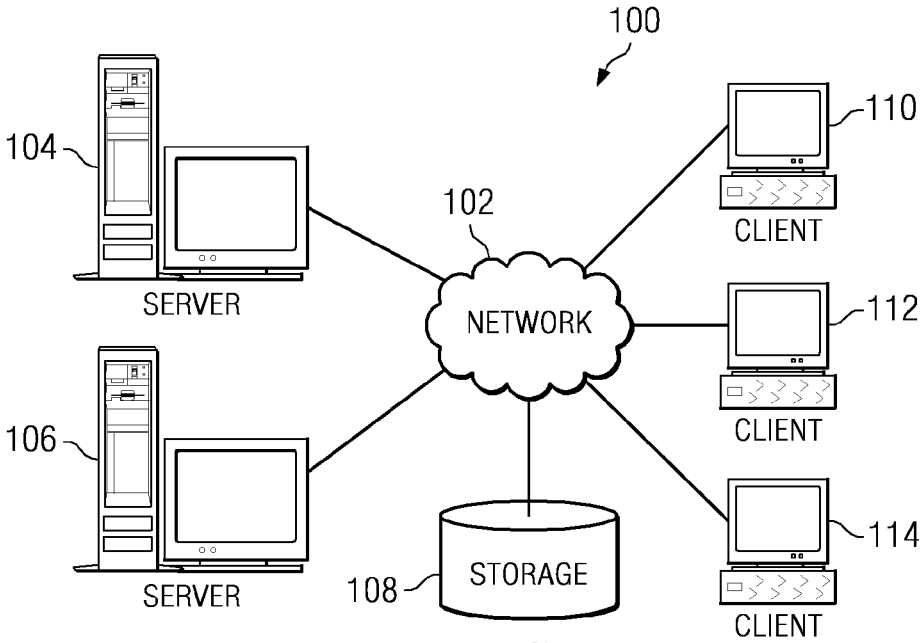
FIG. 1 is a pictorial representation of a network of data processing systems in which illustrative embodiments may be implemented.

As will be appreciated by one skilled in the art, the present invention may be embodied as a system, method or computer program product. Accordingly, the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, the present invention may take the form of a computer program product embodied in any tangible medium of expression having computer-usable program code embodied in the medium.

Any combination of one or more computer-usable or computer-readable medium(s) may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CDROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by, or in connection with, the instruction execution system, apparatus, or device. The computer-usable medium may include a propagated data signal with the computer-usable program code embodied therewith, either in baseband or as part of a carrier wave. The computer-usable program code may be transmitted using any appropriate medium, including but not limited to wireless, wireline, optical fiber cable, RF, etc.

Computer program code for carrying out operations of the present invention may be written in any combination of one or more programming languages, including an object-oriented programming language such as Java, Smalltalk, C++ or the like, and conventional procedural programming languages, such as the "C" programming language or similar programming languages. The program code may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The present invention is described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions.

These computer program instructions may be provided to a processor of a general purpose computer, special purpose computer, or other programmable data processing apparatus to produce a machine, such that the instructions, which execute via the processor of the computer, or other programmable data processing apparatus, create means for implementing the functions/acts specified in the flowchart and/or block diagram block or blocks. These computer program instructions may also be stored in a computer-readable medium that can direct a computer, or other programmable data processing apparatus, to function in a particular manner, such that the instructions stored in the computer-readable medium produce an article of manufacture including instruction means which implement the function/act specified in the flowchart and/or block diagram block or blocks.

The computer program instructions may also be loaded onto a computer, or other programmable data processing apparatus, to cause a series of operational steps to be performed on the computer, or other programmable apparatus, to produce a computer-implemented process such that the instructions which execute on the computer, or other programmable apparatus, provide processes for implementing the functions/acts specified in the flowchart and/or block diagram block or blocks.

Figure 2:
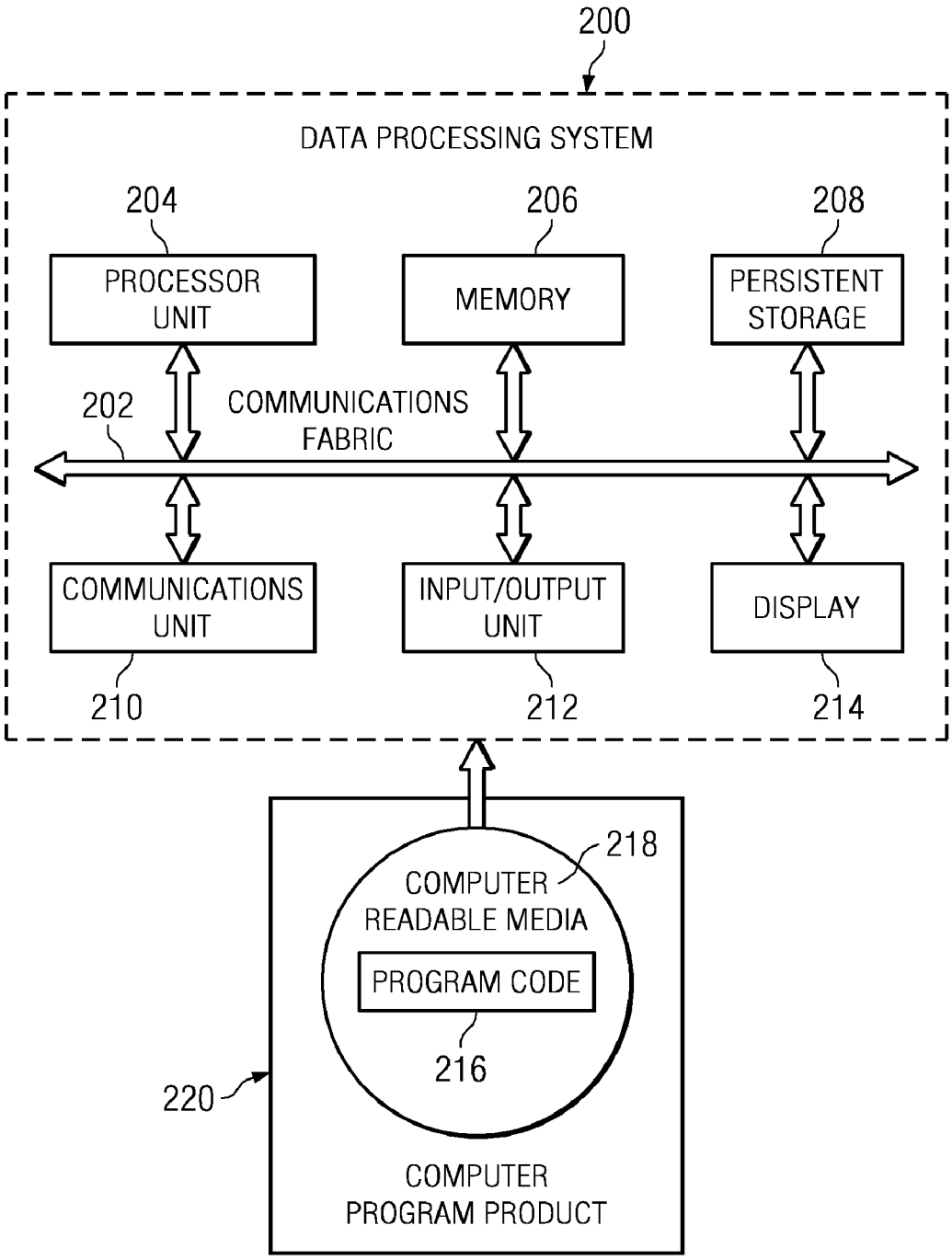
FIG. 2 is a block diagram of a data processing system in which illustrative embodiments may be implemented.

With reference now to the figures, and in particular with reference to FIGS. 1-2, exemplary diagrams of data processing environments are provided in which illustrative embodiments may be implemented. It should be appreciated that FIGS. 1-2 are only exemplary and are not intended to assert or imply any limitation with regard to the environments in which different embodiments may be implemented. Many modifications to the depicted environments may be made.

FIG. 1 depicts a pictorial representation of a network of data processing systems in which illustrative embodiments may be implemented. Network data processing system 100 is a network of computers in which the illustrative embodiments may be implemented. Network data processing system 100 contains network 102, which is the medium used to provide communication links between various devices and computers connected together within network data processing system 100. Network 102 may include connections, such as wire, wireless communication links, or fiber optic cables.

In the depicted example, server 104 and server 106 connect to network 102 along with storage unit 108. In addition, clients 110, 112, and 114 connect to network 102. Clients 110, 112, and 114 may be, for example, personal computers or network computers. In the depicted example, server 104 provides data, such as boot files, operating system images, and applications to clients 110, 112, and 114. Clients 110, 112, and 114 are clients to server 104 in this example. Network data processing system 100 may include additional servers, clients, and other devices not shown.

In the depicted example, network data processing system 100 is the Internet with network 102 representing a worldwide collection of networks and gateways that use the Transmission Control Protocol/Internet Protocol (TCP/IP) suite of protocols to communicate with one another. At the heart of the Internet is a backbone of high-speed data communication lines between major nodes or host computers, consisting of thousands of commercial, governmental, educational, and other computer systems that route data and messages. Of course, network data processing system 100 also may be implemented as a number of different types of networks, such as for example, an intranet, a local area network (LAN), or a wide area network (WAN). FIG. 1 is intended as an example, and not as an architectural limitation for the different illustrative embodiments.

With reference now to FIG. 2, a block diagram of a data processing system is shown in which illustrative embodiments may be implemented. Data processing system 200 is an example of a computer, such as server 104 or client 110 in FIG. 1, in which computer-usable program code or instructions implementing the processes may be located for the illustrative embodiments. In this illustrative example, data processing system 200 includes communications fabric 202, which provides communications between processor unit 204, memory 206, persistent storage 208, communications unit 210, input/output (I/O) unit 212, and display 214.

Processor unit 204 serves to execute instructions for software that may be loaded into memory 206. Processor unit 204 may be a set of one or more processors or may be a multiprocessor core, depending on the particular implementation. Further, processor unit 204 may be implemented using one or more heterogeneous processor systems in which a main processor is present with secondary processors on a single chip. As another illustrative example, processor unit 204 may be a symmetric multi-processor system containing multiple processors of the same type.

Memory 206, in these examples, may be, for example, a random access memory or any other suitable volatile or non-volatile storage device. Persistent storage 208 may take various forms, depending on the particular implementation. For example, persistent storage 208 may contain one or more components or devices. For example, persistent storage 208 may be a hard drive, a flash memory, a rewritable optical disk, a rewritable magnetic tape, or some combination of the above. The media used by persistent storage 208 also may be removable. For example, a removable hard drive may be used for persistent storage 208.

Communications unit 210, in these examples, provides for communications with other data processing systems or devices. In these examples, communications unit 210 is a network interface card. Communications unit 210 may provide communications through the use of either or both physical and wireless communications links.

Input/output unit 212 allows for input and output of data with other devices that may be connected to data processing system 200. For example, input/output unit 212 may provide a connection for user input through a keyboard and mouse. Further, input/output unit 212 may send output to a printer. Display 214 provides a mechanism to display information to a user.

Instructions for the operating system and applications or programs are located on persistent storage 208. These instructions may be loaded into memory 206 for execution by processor unit 204. The processes of the different embodiments may be performed by processor unit 204 using computer-implemented instructions, which may be located in a memory, such as memory 206. These instructions are referred to as program code, computer-usable program code, or computer-readable program code that may be read and executed by a processor in processor unit 204. The program code in the different embodiments may be embodied on different physical or tangible computer-readable media, such as memory 206 or persistent storage 208.

Program code 216 is located in a functional form on computer-readable media 218 that is selectively removable and may be loaded onto or transferred to data processing system 200 for execution by processor unit 204. Program code 216 and computer-readable media 218 form computer program product 220 in these examples. In one example, computer-readable media 218 may be in a tangible form, such as, for example, an optical or magnetic disc that is inserted or placed into a drive or other device that is part of persistent storage 208 for transfer onto a storage device, such as a hard drive that is part of persistent storage 208. In a tangible form, computer-readable media 218 also may take the form of a persistent storage, such as a hard drive, a thumb drive, or a flash memory that is connected to data processing system 200. The tangible form of computer-readable media 218 is also referred to as computer-recordable storage media. In some instances, computer-readable media 218 may not be removable.

Alternatively, program code 216 may be transferred to data processing system 200 from computer-readable media 218 through a communications link to communications unit 210 and/or through a connection to input/output unit 212. The communications link and/or the connection may be physical or wireless in the illustrative examples. The computer-readable media also may take the form of non-tangible media, such as communication links or wireless transmissions containing the program code.

The different components illustrated for data processing system 200 are not meant to provide architectural limitations to the manner in which different embodiments may be implemented. The different illustrative embodiments may be implemented in a data processing system including components in addition to, or in place of, those illustrated for data processing system 200. Other components shown in FIG. 2 can be varied from the illustrative examples shown.

As one example, a storage device in data processing system 200 is any hardware apparatus that may store data. Memory 206, persistent storage 208, and computer-readable media 218 are examples of storage devices in a tangible form.

In another example, a bus system may be used to implement communications fabric 202 and may be comprised of one or more buses, such as a system bus or an input/output bus. Of course, the bus system may be implemented using any suitable type of architecture that provides for a transfer of data between different components or devices attached to the bus system. Additionally, a communications unit may include one or more devices used to transmit and receive data, such as a modem or a network adapter. Further, a memory may be, for example, memory 206 or a cache such as found in an interface and memory controller hub that may be present in communications fabric 202.

Exemplary embodiments provide for monitoring patterns of motion. Exemplary embodiments monitor patterns of motion, such as breathing and movement in order to determine suspect patterns. Once a suspect pattern is detected, a set of rules are checked to determine whether to generate an alert and to whom to send the alert. Exemplary embodiments also provide for monitoring pressure or strain on a body. The signal produced by a sensor will vary, functionally, in voltage in response to the amount of pressure applied to the sensor. The functional relationships may be empirically determined and are known in the art.

In 2003, almost 1.8 million seniors were treated in emergency departments for non-fatal injuries from falls and more than 460,000 were hospitalized. If an elderly person falls while wearing a Medical alert bracelet or pendant, they must be conscious and coherent enough to be able to find and press the button in order to obtain help. Unfortunately, in the case of heart attacks, strokes, head injuries, and other serious situations, seniors may not be able to press the button for help. It's worth noting that the first three hours after a stroke has occurred are the most important in terms of immediately seeking medical care. Immediate access to medical care is critical to the long-term well-being of the patient, according to many experts. Getting immediate access for seniors will become more of a problem over time as the US population ages. In 2006, persons 65 years old and older were 12.4% of the population. According to government estimates, by 2030, persons 65 years old and older are expected to be 20% of the population. Being able to detect the fall and to report an alert without requiring intervention by the senior could help to increase long-term quality of life for the senior.

On the industrial side, according to the government, there were over 800 workplace fatalities related to falls in 2006. The Bureau of Labor Statistics reported that, in 2004, for nonfatal injuries involving one (1) or more days away from work, falls were the third most common cause, accounting for 255,600 (20%) of 1,259,320 injuries/illnesses. The majority of these falls occurred on one level (65%, 167,010) or to a lower level (31%, 79,800).

Beyond falls, in 2005, the US Department of Labor reports that there were 135.7 injuries and illnesses per 10,000 full-time equivalent workers in private industry. As was the case in previous years, more than 4 out of 10 of injuries and illnesses were sprains or strains.

In the automotive industry, it's common for individuals "on the line" to repeat a movement to install a device once per minute. As an example, one United Auto Worker interviewed on National Public Radio reported having to climb through the window of a vehicle, install a device, and climb back out in a matter of seconds. Measuring movements of specific muscles that are prone to injury, reporting on the movements, and monitoring for movements outside of the expected range could help to prevent injuries.

Also, Sudden Infant Death Syndrome (SIDS) is the third-ranking cause of infant death between one month and one year of age. According to the National Vital Statistics Reports: Deaths Final Data for 2003. Vol. 54(13); Apr. 19, 2006, in 2003, 2,162 infants died from SIDS, accounting for 7.7 percent of all deaths among infants. By easily and inexpensively monitoring body movement related to breathing, reporting changes in the pattern, and providing an alert at the first sign of distress, the infant could receive prompt medical attention.

Figure 3:
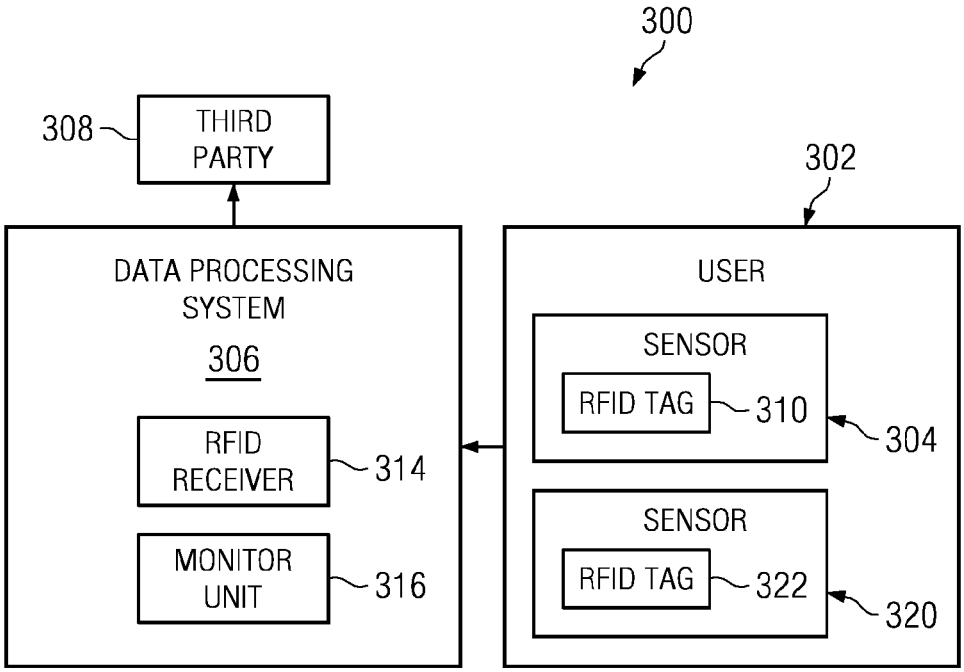
FIG. 3 is a block diagram illustrating a system for monitoring patterns of motion, in accordance with an exemplary embodiment.

Turning back to the Figures, FIG. 3 is a block diagram illustrating a system for monitoring patterns of motion, in accordance with an exemplary embodiment generally designated as reference numeral 300. System 300 comprises user 302, sensors 304 and 320, data processing system 306, and third party 308. Sensor 304 comprises radio frequency identity tag (RFID tag) 310. Sensor 320 comprises RFID tag 322. While system 300 shows an example of just two sensors, (sensors 304 and 320) attached to a user, exemplary embodiments contemplate and encompass systems using just one sensor or any number sensors attached to a user to monitor various activities. A user can be a person, an animal, such as a dog or a horse, or a device, such as a robotic arm attached to a person. While exemplary embodiments contemplate the one or more sensors being attached to the physical body of a user, other exemplary embodiments contemplate the one or more sensors being attached to apparel and other wearable items worn by the user, such as a harness or collar for example, in the case of animals, or a watch or a hat, for example, in the case of a person.

Data processing system 306 may be implemented as data processing system 200 of FIG. 2. Data processing system 306 comprises RFID receiver 314 and monitor unit 316. Third party 308 is a third party that receives and responds to medical alerts issued by monitor unit 316.

According to an exemplary embodiment, sensors 304 and 320 are piezoelectric sensors combined with a semi-passive RFID tag, where the piezoelectric activity is used to help power the semi-passive RFID tag. When one or more sensor(s) 304 and 320 are attached to user 302, the movement of user 302 provides power to sensors 304 and 320, which causes RFID tags 310 and 322 to emit a signal that is transmitted to RFID receiver 314 in data processing system 306.

Exemplary embodiments use a semi-passive RFID tag because the semi-passive RFID tag emits lower RF levels and is more resilient to any RF shielding caused by the person's body. The semi-passive RFID tag is powered by a piezoelectric generator which converts mechanical energy to electrical energy. Piezoelectric material is also used to sense movement.

Exemplary embodiments use a Polyvinylidene Fluoride (PVDF) piezoelectric material, which is a relatively new class of piezoelectric sensors. The material is a thin plastic polymer sheet that has a thin, electrically conductive nickel copper alloy deposited on each side. The material resembles aluminum foil and easily conforms to irregular shapes, but is much more resilient. Piezoelectric materials are a class of polymers (mostly crystals and certain ceramics) that are able to generate an electric potential when they undergo some kind of deformation (applied mechanical stress). There are many materials in this category starting with the most well-known piezoelectric material quartz ($SiO_2$), PVDF based compounds, PZT (a ceramic Lead zirconate titanate)-based compound, and Lithium niobate ($LiNbO_3$), crystalline compounds, to name just a few are also in this group of materials.

PVDF is a highly non-reactive and pure thermoplastic fluoropolymer that goes by trade names of KYNAR, HYLAR or SYGEF. Copolymers of PVDF based compounds have a much higher crystallinity and hence a larger piezoelectric response than a pure form of the PVDF material. The piezoelectric coefficient of the poled thin films of this compound material are ten (10) times larger than that observed in any other polymer such as PZT. In addition the PVDF based copolymers possess other material's properties such as low acoustical impedance and toughness (not brittle like PZT) that make PVDF a preferred choice for the present application. PVDF has low acoustic impedance and is flexible. The low acoustic impedance of the PVDF material is similar to that of the human body.

The transducer consists of an elastic band holding the PVDF piezo-film sensor. The elastic band can be elastic fabric with adhesive backing to secure the device to areas of the body where a wraparound band would be inconvenient, for example, at the diaphragm of an infant, or a wraparound band to secure the device to areas of the body where convenient, such as the wrist, thigh, ankle, lower back, etc.

Most of the piezo-film sensors have wire connections. However, electrical connections can be added to raw piezo-film by using either copper tape or a conductive epoxy. When one layer of the piezoelectric material is compressed and the other is stretched, a charge develops across each layer in an effort to counteract the imposed strain. This charge may be collected for strain sensing or power generation.

A power conditioning circuit stores and transforms the energy so that it can be used by the semi-passive RFID tag. The alternating current signal produced by the piezoelectric power generator is stored in a capacitor. A comparator monitors the voltage level of the capacitor and current is allowed to flow through when it has reached the high mark. The switch is turned off to allow the capacitor to charge again. DC power is used to power the RFID tag. Since piezoelectronics produce high voltages at low currents and standard electronic circuitry requires low voltages at high currents, an electronic converter unit is used to convert the high voltage pulses of the piezo-generator into a suitable DC current for supplying the transmitter module. In a very simple embodiment, the electronic converter unit may comprise a simple diode as rectifier and/or voltage limiter.

Monitor unit 316 monitors the data from RFID receiver 314 and analyzes the data for problematic patterns. It analyzes the data by comparing the received data to either a baseline established for the user or by comparing the received data against a predetermined normal pattern for that activity being monitored. Thus, when a user first puts on sensor(s) 304 and 320, monitor unit 316 must programmed and data gathered to establish a baseline for the user. After that, the baseline is used for the comparison of newly received data.

If monitor unit 316 determines that the received data shows a movement pattern that exceeds the baseline or normal pattern by more than a set threshold amount, a configurable alert is initiated and sent to third party 308. The alert may be initiated through a telephone call using either a cell phone or land line, issued by displaying the alert to a screen in another location by providing a warning displayed to a monitored terminal, and other forms of notification, dependent on the specific implementation.

In another exemplary embodiment, system 300 comprises multiple RFID receiver(s) 314. The semi passive tags, RFID tags 310 and 320, would send a signal that could be triangulated by the multiple RFID receivers. Thus, with receivers in multiple locations, monitor unit 316 would be able to report on the location of the individual at the time of injury. In another exemplary embodiment, monitor unit 316 could provide a window during which someone could deactivate the alert prior to action being taken, such as allowing 15 seconds before dialing 911 or a family member, etc.

Thus, in the case of a senior citizen for example, sensors 304 and 320 could be used to monitor the breathing rate and pattern of the senior, as well as the movement of the senior. Monitor unit 316 would then be able to compare the current breathing pattern and rate of the senior and determine whether the pattern has become too fast, too slow, or simply irregular, thereby sending an alert to third party 308, informing third party 308 of the problem detected. Also, as a baseline has been established for the senior, monitor unit 316 would be able to determine when the breathing pattern represents a conscious individual versus a sleeping individual versus and an unconscious individual.

To monitor movement patterns, monitor unit 316 compares the presently received location of sensors 304 and 320 and compares that to the previous location of sensors 304 and 320, taking in to account the time between the two measurements and calculates an acceleration. This is used as part of the determination of an irregular pattern. However, as the system is customized for each individual, the age, condition and baseline movement pattern for the individual is also used. While a certain movement speed may indicate a fall for a senior or one particular user, the same movement speed may be seen as normal for a child or other user. Thus, the establishment and use of a configurable baseline for each individual provides more accuracy in determining an irregular or unsafe pattern of movement.

In an industrial setting, exemplary embodiments provide for monitoring the repetitive motion of individuals on the factory floor. For example, system 300 could be used to monitor how an employee performs a certain task, compare the employee's pattern of movement against a predetermined, most efficient set of motions, and determine where improvements can be made. Further, the motion of various parts of the employee, such as the arm, can be monitored to detect possible injuries. For example, the wrist could be monitored in order to detect patterns of movement that might cause carpal tunnel syndrome. Another example would be to monitor the movement of the torso or arm. The pattern of movement by the employee could be compared to a standardized set of motions to possibly catch when someone is becoming off balance, or doing something that might cause a muscle strain or pull.

Furthermore, in another exemplary embodiment, the amount of strain on the sensor can be measured. The amount of pressure on the sensor will cause the voltage produced by the sensor to vary. This variance can be monitored to determine an amount of pressure or strain on the sensor, thus detecting dangerous or harmful situations.

Figure 4:
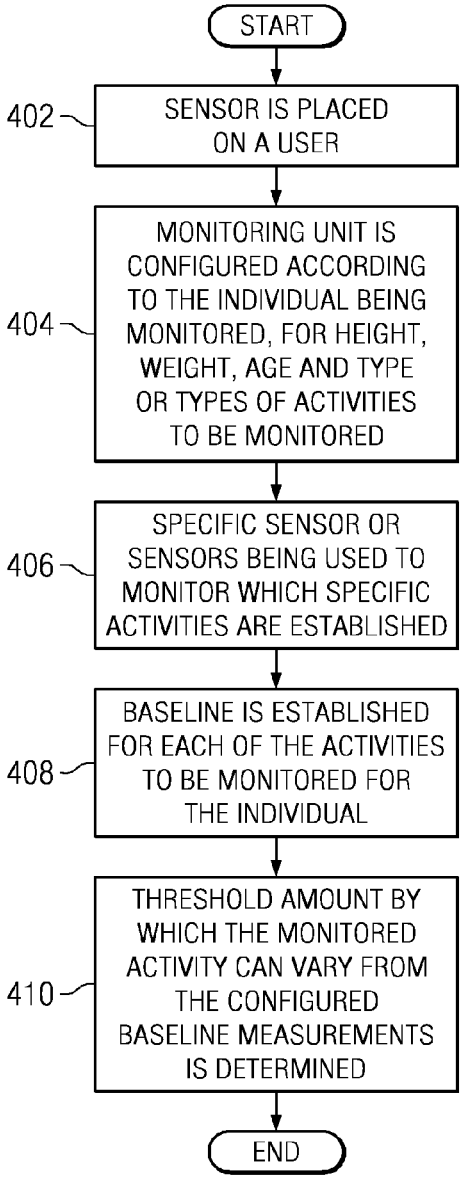
FIG. 4 is a flowchart illustrating the operation of establishing a configurable baseline pattern of motion, in accordance with an exemplary embodiment.

FIG. 4 is a flowchart illustrating the operation of establishing a configurable baseline pattern of motion, in accordance with an exemplary embodiment. FIG. 4 may be implemented in system such as system 300 of FIG. 3. The operation begins when a sensor is placed on a user (step 402). A monitoring unit is configured according to the individual being monitored, for height weight, age and type or types of activities to be monitored (step 404). Which specific sensor or sensors are being used to monitor which specific activities is also established (step 406). A baseline is established for each of the activities to be monitored for the individual (step 408). The baseline is established by having the user perform the activity a predetermined number of times, at which point a normal or average pattern is established based on the measured activity. A threshold amount by which the monitored activity can vary from the configured baseline measurements is determined (step 410) and the operation ends. This threshold may be a percentage or the base number or a range from the baseline measurement, depending on the particular implementation and activity being monitored.

Figure 5:
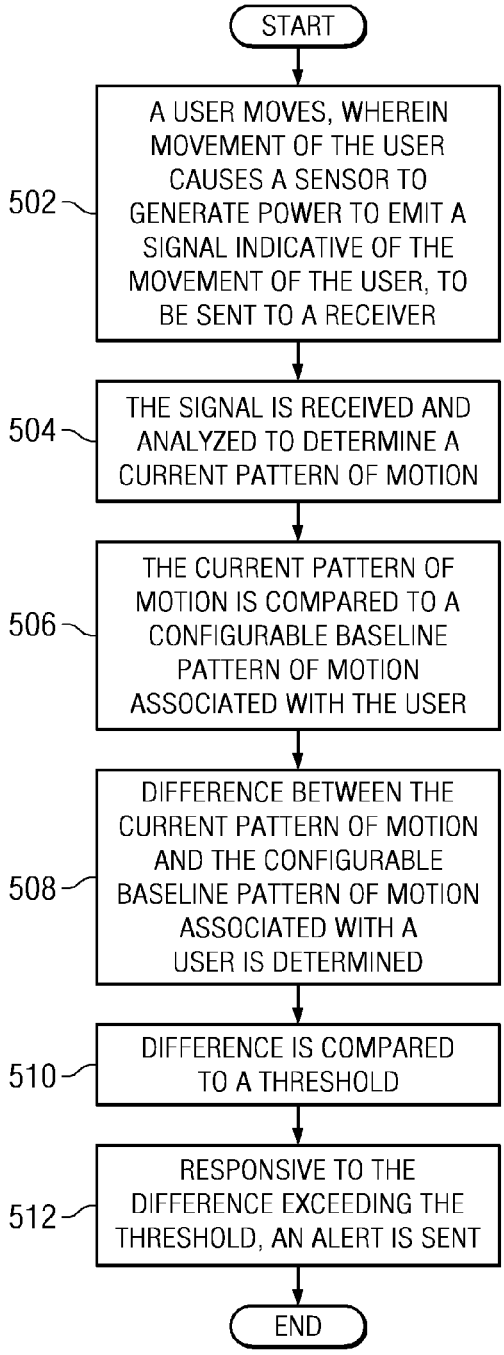
FIG. 5 is a flowchart illustrating the operation of monitoring patterns of motion, in accordance with an exemplary embodiment.

FIG. 5 is a flowchart illustrating the operation of monitoring patterns of motion, in accordance with an exemplary embodiment. FIG. 5 may be implemented in system such as system 300 of FIG. 3. The operation begins when a user moves, wherein movement of the user causes a sensor to generate power to emit a signal indicative of the movement of the user, to be sent to a receiver (step 502). This signal may comprise, but is not limited to an RFID signal, light, an electro magnetic signal, noise, or thermal signal. The signal is received and the signal is analyzed to determine a current pattern of motion (step 504). The current pattern of motion is compared to a configurable baseline pattern of motion associated with the user (step 506). A difference between the current pattern of motion and the configurable baseline pattern of motion associated with the user is determined (step 508). The difference is compared to a threshold (step 510). Responsive to the difference exceeding the threshold, an alert is sent (step 512) and the operation ends. In an exemplary embodiment, the alert is sent to the user. In another exemplary embodiment the alert is sent to a third party. In a further exemplary embodiment, the alert is sent to the user and to one or more third parties.

Further, the amount of pressure of strain on an individual, or an individual joint, or location can also be monitored as an activity. Thus, a baseline amount of strain is established for the user and a threshold amount by which the strain can vary from the configured baseline measurements is determined, as in steps 408 and 410 of FIG. 4. As explained in FIG. 5, in regards to a pattern of motion, the amount of strain can also be monitored. A signal is received from a sensor and analyzed to determine a current amount strain. This current amount of strain is then compared to the configurable baseline associated with the user. A difference between the baseline amount of strain and the current amount of strain is determined and compared to a threshold. Responsive to this strain difference exceeding a threshold, an alert is sent.

In an exemplary embodiment the alert includes the specific location of the user within a predefined area, such as in the living room of a house of seven feet south of junction 7 or 14 feet from the north end of catwalk 22, etc., as well as the possible nature of the problem, such as a fall, heart attack, unconsciousness, not breathing, etc. Further, in another exemplary embodiment, there is a delay before the monitor unit sends the alert, giving the user the opportunity to abort the alert before the alert is sent.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements, as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention, the practical application, and to enable others of ordinary skill in the art to understand the invention for various embodiments, with various modifications as are suited to the particular use contemplated.

The invention can take the form of an entirely hardware embodiment, an entirely software embodiment or an embodiment containing both hardware and software elements. In a preferred embodiment, the invention is implemented in software, which includes but is not limited to firmware, resident software, microcode, etc.

Furthermore, the invention can take the form of a computer program product accessible from a computer-usable or computer-readable medium providing program code for use by, or in connection with, a computer or any instruction execution system. For the purposes of this description, a computer-usable or computer-readable medium can be any tangible apparatus that can contain, store, communicate, propagate, or transport the program for use by, or in connection with, the instruction execution system, apparatus, or device.

The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk—read only memory (CD-ROM), compact disk—read/write (CD-R/W) and DVD.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments, with various modifications as are suited to the particular use contemplated.

What is claimed is:

1. A computer-implemented method for monitoring patterns of motion, the computer-implemented method comprising:

receiving a signal from a sensor on a user, wherein movement of the user causes the sensor to generate power to emit a signal indicative of the movement of the user;

analyzing the signal to form a current pattern of motion;

comparing the current pattern of motion to a baseline pattern of motion associated with the user;

determining a difference between the current pattern of motion and the baseline pattern of motion associated with the user to form a difference;

comparing the difference to a predetermined threshold; and responsive to the difference exceeding the predetermined threshold, sending an alert.

2. The computer-implemented method of claim 1, wherein the alert includes the specific location of the user within a predefined area.

3. The computer-implemented method of claim 1, wherein the alert includes a description of the detected problem.

4. The computer-implemented method of claim 1, wherein the alert is sent after a predetermined time during which the user can cancel the alert.

5. The computer-implemented method of claim 1, further comprising:

configuring a monitoring unit for a type of activity to be monitored and for the user to be monitored; and establishing the baseline pattern of motion associated with the user for the activity to be monitored.

6. The computer-implemented method of claim 1, wherein the signal is a signal from a radio frequency identity tag.

7. The computer-implemented method of claim 1, further comprising:

establishing a baseline amount of strain for a user, comparing a current amount of strain to the baseline amount of strain associated with the user;

determining a difference between the current amount of strain and the baseline amount of strain associated with the user to form a strain difference;

comparing the strain difference to a predetermined threshold; and responsive to the strain difference exceeding the predetermined threshold, sending the alert.

8. A computer program product comprising:

computer recordable storage medium;

computer useable program code, stored on the computer recordable storage medium, for receiving a signal from a sensor on a user, wherein movement of the user causes the sensor to generate power to emit a signal indicative of the movement of the user;

computer useable program code, stored on the computer recordable storage medium, for analyzing the signal to form a current pattern of motion;

computer useable program code, stored on the computer recordable storage medium, for comparing the current pattern of motion to a baseline pattern of motion associated with the user;

computer useable program code, stored on the computer recordable storage medium, for determining a difference between the current pattern of motion and the baseline pattern of motion associated with the user to form a difference;

computer useable program code, stored on the computer recordable storage medium, for comparing the difference to a predetermined threshold; and computer useable program code, stored on the computer recordable storage medium, for, responsive to the difference exceeding the predetermined threshold, sending an alert.

9. The computer program product of claim 8, wherein the alert includes the specific location of the user within a predefined area.

10. The computer program product of claim 8, wherein the alert includes a description of the detected problem.

11. The computer program product of claim 8, wherein the alert is sent after a predetermined time during which the user can cancel the alert.

12. The computer program product of claim 8, further comprising:

computer useable program code, stored on the computer recordable storage medium, for configuring a monitoring unit for a type of activity to be monitored and for the user to be monitored; and computer useable program code, stored on the computer recordable storage medium, for establishing the baseline pattern of motion associated with the user for the activity to be monitored.

13. The computer program product of claim 8, wherein the signal is a signal from a radio frequency identity tag.

14. The computer program product of claim 8, further comprising:

computer useable program code, stored on the computer recordable storage medium, for establishing a baseline amount of strain for a user, computer useable program code, stored on the computer recordable storage medium, for comparing a current amount of strain to the baseline amount of strain associated with the user;

computer useable program code, stored on the computer recordable storage medium, for determining a difference between the current amount of strain and the baseline amount of strain associated with the user to form a strain difference;

computer useable program code, stored on the computer recordable storage medium, for comparing the strain difference to a predetermined threshold; and computer useable program code, stored on the computer recordable storage medium, for, responsive to the strain difference exceeding the predetermined threshold, sending the alert.

15. An apparatus comprising:

a bus;

a storage device connected to the bus, wherein the storage device contains computer usable code;

at least one managed device connected to the bus;

a communications unit connected to the bus; and a processing unit connected to the bus, wherein the processing unit executes the computer usable code to receive a signal from a sensor on a user, wherein movement of the user causes the sensor to generate power to emit a signal indicative of the movement of the user; analyze the signal to form a current pattern of motion; compare the current pattern of motion to a baseline pattern of motion associated with the user; determine a difference between the current pattern of motion and the baseline pattern of motion associated with the user to form a difference; compare the difference to a predetermined threshold; and responsive to the difference exceeding the predetermined threshold, send an alert.

16. The apparatus of claim 15, wherein the alert includes the specific location of the user within a predefined area.

17. The apparatus of claim 15, wherein the alert includes a description of the detected problem.

18. The apparatus of claim 15, wherein the alert is sent after a predetermined time during which the user can cancel the alert.

19. The apparatus of claim 15, wherein the processing unit further executes the computer usable code to configure a monitoring unit for a type of activity to be monitored and for the user to be monitored; and establish the baseline pattern of motion associated with the user for the activity to be monitored.

20. The apparatus of claim 15, wherein the processing unit further executes the computer usable code to establish a baseline amount of strain for a user, compare a current amount of strain to the baseline amount of strain associated with the user; determine a difference between the current amount of strain and the baseline amount of strain associated with the user to form a strain difference; compare the strain difference to a predetermined threshold; and responsive to the strain difference exceeding the predetermined threshold, send the alert.

* * * * *